US005176023A

United States Patent [19]

Baldwin

[11] Patent Number: 5,176,023

[45] Date of Patent: Jan. 5, 1993

[54] DIE SET CARRYING APPARATUS AND METHOD

[75] Inventor: John B. Baldwin, Warrenville, Ill.

[73] Assignee: Caterpillar Inc., Peoria, Ill.

[21] Appl. No.: 819,724

[22] Filed: Jan. 13, 1992

[51] Int. Cl.[5] ..... B21J 13/03

[52] U.S. Cl. ..... 72/446; 72/389; 72/481

[58] Field of Search ..... 72/389, 446, 448, 477, 72/481, 482

[56] References Cited

U.S. PATENT DOCUMENTS 3,270,605 9/1966 Schott et al. ..... 72/481
4,866,975 9/1989 Hopkins ..... 72/389

FOREIGN PATENT DOCUMENTS 0234721 11/1985 Japan ..... 72/389
0234722 11/1985 Japan ..... 72/389

*Primary Examiner*—David Jones
*Attorney, Agent, or Firm*—Alan J. Hickman

[57] ABSTRACT

A die set having first and second dies is provided with first and second handles for carrying the die set. The first and second handles are each pivotally connected to the second die by a pin. First and second latches maintains the first and second handles at a carry position and from inadvertent pivotal movement. Each latch is releasable to permit axial movement of the handles relative to the pins and thus free the first and second handles for pivotal movement to a position at which the handles are free from interfering with connection to a ram of a press. A support is provided for maintaining the first die at a preselected position relative to the second die and from inadvertent movement relative to the second die. A lever enables rocking of the first die relative to the second so that connection to the ram of the press is easily achieved.

23 Claims, 8 Drawing Sheets

DIE SET CARRYING APPARATUS AND METHOD

DESCRIPTION

1. Technical Field

This invention relates to a carrying arrangement for a die set and method of use and more particularly to a die set having first and second matable dies and first and second spaced die carriers pivotally connected to the second die.

2. Background Art

Die sets have been utilized on presses for decades to form, shape, bend, and pierce material such as steel plate. Typically, the press has a ram and bed to which first and second dies of the die set is to be attached. The first and second dies which weigh a substantial amount are often transported individually by a lifting device such as an over head crane to and from the press for attachment or removal purposes. Because the dies are individually transported the time required to transport each die is twice that of the time required to transport a die set.

In applications where the first and second dies are carried individually the forming surface of the die is exposed and subject to damage. Such damage is caused by impact with objects as the die is being transported through a manufacturing facility. The potential for damage is particularly prevalent when an over head crane is used and the die is freely carried.

When the first and second dies are transported individually the potential for the matched set to be mixed with other die sets is possible. This is particularly prevalent in situations where there are several presses serviced by several different people and several different lifting devices at the same time. Such a situation is not acceptable and emphasizes the need for the dies to be transported in sets.

There has been occasions in the past where die sets were transported in pairs to the press by means other than an overhead crane, for example a fork lift. Placement of the die set at a precise location relative to the bed and ram of the press is extremely difficult when transported in this manner and in many cases impossible. Therefore other lifting and transporting devices are required to assist in accurate placement of the die set. Such devices include an overhead crane and the equivalent.

It has been known to provide bolt-like extensions on opposite ends of the first and second dies to enable an overhead crane to individually carry, by way of a chain, hooks and the like, the dies. Such an arrangement would appear to have the capability of successfully carrying die sets. However, instability of the die set due to the location of the center of mass and swinging of the die set during transportation tends to cause dumping of the loose die being supported on the connected die. Thus in only a few applications is this arrangement suitable for use. Further, positioning of the die sets relative to the ram and bed using extensions and a lifting arrangement of this type is extremely difficult and likely to be avoided by a pressman.

The present invention is directed to overcoming one or more of the problems as set forth above.

DISCLOSURE OF THE INVENTION

In one aspect of the present invention, a die set carrying arrangement having first and second mated dies is provided. The dies each have a forming surface. The first die forming surface is in cradled engagement with said second die forming surface. First and second die carriers having a handle and a lifting device engaging means connected to each of said handles is provided. A first pin means pivotally and axially slidably connects the first die carrier handle to the second die. A second pin means pivotally and axially slidably connects the second die carrier handle to the second die. A first latch means maintains the first die carrier handle from pivotal movement about the first pin means in response to the first die carrier handle being at a first axial position on the first pin means. A second latch means maintains the second die carrier handle from pivotal movement about the second pin means in response to the second die carrier handle being at a first axial position on the second pin means.

In another aspect of the present invention, a method for positioning a die set relative to a press having a bed and a ram. The die set has first and second dies, first and second die carrier handles pivotally connected to the second die, and pivotally movable between a first position at which the die set is adapted to be carried by the first and second die carrier handles, and a second position spaced from the first position at which the first die is adapted to be connected to the ram. The method comprises: carrying the die set by the first and second die carrier handles; placing the second die in position on the bed; pivoting first and second die carrier handles to the second position and freeing the die carrier handles from interference with the ram; and connecting the ram to the first die.

In yet yet another aspect of the present invention, a carrying arrangement for a die set having first and second matable dies is provided. The matable dies each having a forming surface. The first die forming surface is cradled by the second die forming surface. First and second die carriers each having a handle and a lifting device engaging member connected to each of said handles is provided. A first pin means pivotally connects the first die carrier handle to the second die. A second pin means pivotally connects the second die carrier handle to the second die. The first and second die carrier handles are spaced from each other. A first latch means maintains the first die carrier handle from pivotal movement about the first pin means and at a preselected die set carrying position. A second latch means maintains the second die carrier handle from pivotal movement about said second pin means and at a preselected die set carrying position. The first and second latch means are each movable to release the first and second die carrier handles for pivotal movement about the first and second pin means.

The first and second die carriers enable the die set to be carried with a reduced amount of tipping motion as the center of mass is moved downwardly relative to the lifting device engaging member. The length of the handles of the first and second die carrier provides for this feature.

Because the first and second die carriers are pivotally movable from the carrying position interference between the ram and the die carriers during connection of the ram to the first die is eliminated.

The first and second latching means insures that inadvertent pivotal movement of the first and second die carriers is prevented. Thus, the first and second die carriers will remain at the carrying positions whenever the latching means is engaged.

The provision of the lever arm provides for rocking of the first die relative to the second die and subsequent alignment of the first die with the ram during connecting of the ram to the first die.

The support means maintains the first die at a predetermined orientation relative to the second die and prevents inadvertent movement relative thereto. Thus, connection of the first die to the ram is simplified as misalignment due to movement between the first and second dies is eliminated. Also, the support means eliminates the potential for separation of the first die from the second die during transport and storage.

BEST MODE FOR CARRYING OUT THE INVENTION

Figure 1:
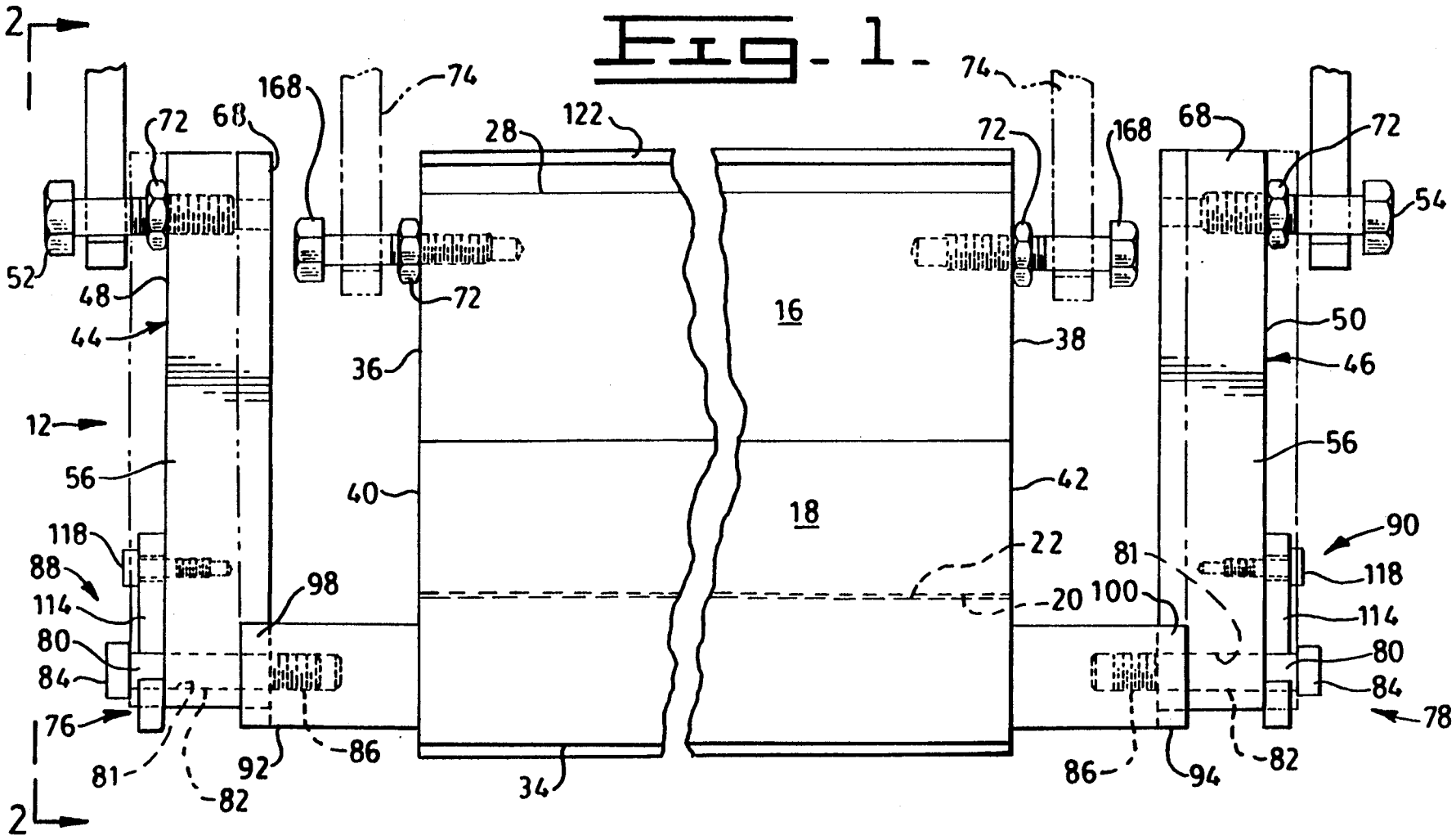
FIG. 1 is a diagrammatic side view of an embodiment of a die set carrying arrangement of the present invention.

With reference to the drawings, a die set carrying arrangement 10 is provided for carrying a die set 12 between a storage location (not shown) and a press brake 14 (FIGS. 3–5, 8–10, and 13–16) for use in bending plate stock. As best seen in FIGS. 1, 2, 6, and 7 the die set 12 has first and second matingly engageable dies 16,18. The first and second dies 16,18 each have a forming surface 20,22, respectively. The forming surfaces 20,22 are matingly engaged so that the dies 16,18 may be transported and stored in pairs. The first die 16 has first and second sides 24,26 and a bearing surface 28. The first and second sides are between the bearing surface 28 and the forming surface 20. Preferably the sides 24,26 are parallel to each other. The second die 18 has first and second substantially parallel sides 30,32 and a bearing surface 34. The first and second sides are located between the bearing surface 34 and the forming surface 22. As best seen in FIGS. 1 and 6 the first die 16 has first and second spaced apart ends 36,38 and the second die 18 has first and second spaced apart ends 40,42.

Figure 2:
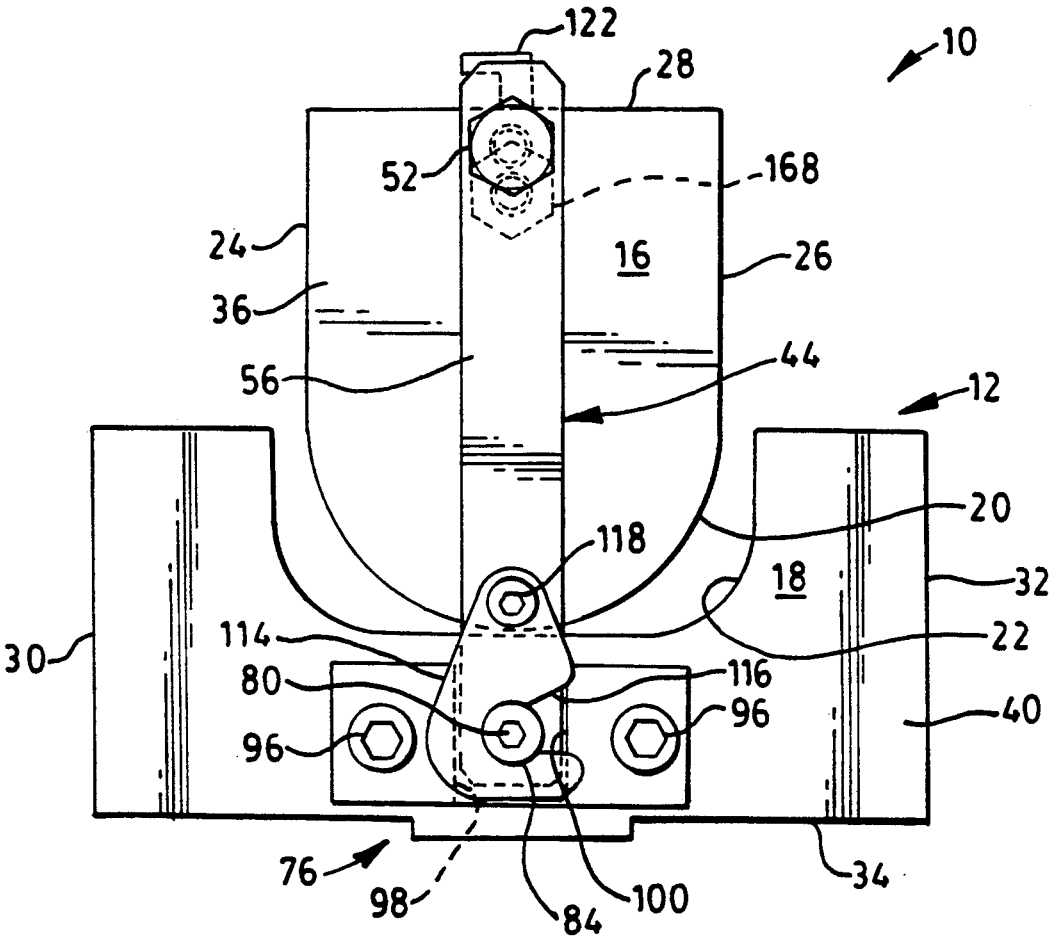
FIG. 2 is a diagrammatic end view of the embodiment of FIG. 1 taken along lines 2—2 of FIG. 1.
Figure 6:
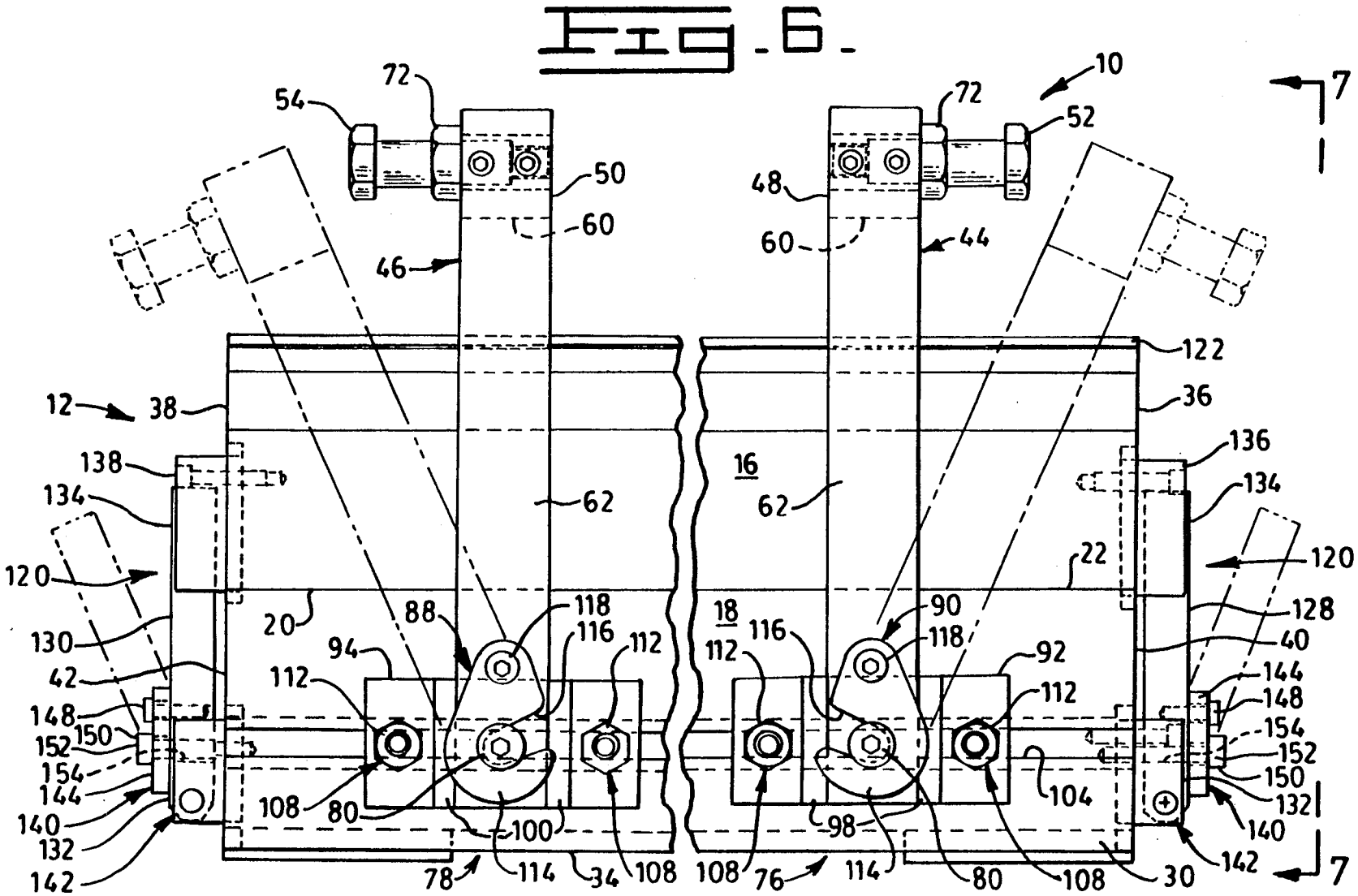
FIG. 6 is a diagrammatic side view of another embodiment of a die set carrying arrangement of the present invention.
Figure 7:
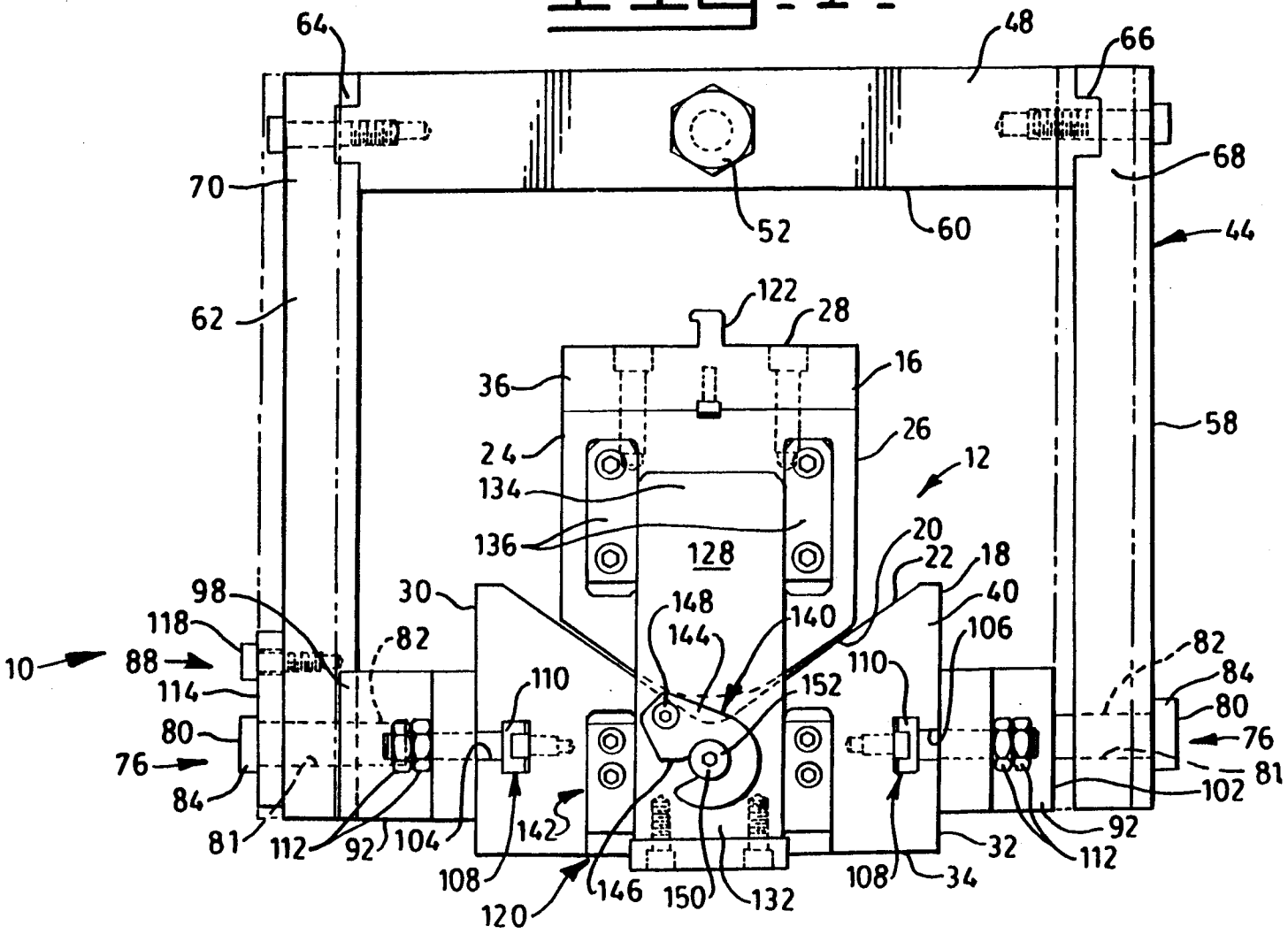
FIG. 7 is a diagrammatic end view taken along lines 7—7 of FIG. 6 showing the die set carrying arrangement in greater detail.

First and second die carriers 44,46 including a handle 48,50, respectively, and a lifting device engaging member 52,54 connected to the handles 48,50, respectively are provided. In one embodiment as shown in FIGS. 1 and 2 the handles 48 and 50 each include a single elongated bar 56. In FIGS. 6 and 7, another embodiment of the present invention, the handles 48 and 50 each consist of first, second, and third elongated bars 58,60,62. The first and third elongated bars 58,62 define first and second end portions of the first and second die carriers 44,46. The second elongated bar 60 is connected at opposite ends 64,66 to an end portion 68,70 of the first and third elongated bars 58,62, respectively. The lifting device engaging members 52,54 are connected to the second elongated bars 60 of the first and second die carriers 44,46, respectively, and extend outwardly therefrom in directions transversely of the first and second ends of the second die 40,42. It is to be noted that the first and second lifting device engaging members 52,54 of the embodiment as shown in FIGS. 1 and 2 also extends outwardly from the first and second die carrier handles 48,50. It should be noted that the lifting device engaging members 52,54 are threaded bolts having a head, and a shank screw threadably connected to the handles 48,50. A jam nut 72 screw threadably connected to the shank of each of the first and second lifting device engaging members 52,54 is provided to retain the lifting device engaging members 52,54 from rotation and maintains the shank portion at a preselected extended distance outwardly from the respective handles 48,50. The amount of extension is a function of the type and size of a load lifting device 74 to be connected thereto.

A first pin means 76 is provided for pivotally and axially slidably connecting the first die carrier handle 48 to the second die 18. In the same manner a second pin means 78 is provided for pivotally and axially slidably connecting the second die carrier handle 50 to the second die 18. The first and second pin means 76,78 each include at least one pin 80 having a cylindrical shank 82, a head 84 at one end portion of the pin 80, and a plurality of threads 86 at the other end portion of the cylindrical shank 82. In the embodiment of the invention as shown in FIGS. 1 and 2, a single pin 80 is provided for each of the first and second die carriers 44,46 and in the embodiment of FIGS. 6 and 7, a pair of pins 80 for each of the first and second die carriers 44,46 is provided. In FIGS. 1 and 2, the first and second pin means 76,78 are connected to the first and second ends 40,42, respectively, of the second die 18, and in FIGS. 6 and 7, the first and second pin means 76,78 are connected to the first and second sides 30,32 of the second die 18. In each embodiment disclosed herein, the pin means 76,78 is disposed in a bore 81 in the first and second die carrier handles 48,50.

A first latch means 88 is provided for maintaining the first and second die carrier handles 48,50 from pivotal movement about the first pin means 76 at a first axial position of the first die carrier handle 44 on the first pin means 76. In the same manner, a second latch means 90 is provided for maintaining the second die carrier handle 50 from pivotal movement about the second pin means 78 at a first axial position of the second die carrier handle 50 on the second pin means 78.

As best seen in FIGS. 1 and 7 the first and second die carrier handles 48,50 are slidably axially movable along the pins 80 between a first position at which pivotal movement about the pin 80 is prevented and a second axial position as shown in phantom lines where the first and second die carrier handles 48,50 are free to pivot about the pins 80.

Referring to FIGS. 1 and 2, first and second blocks 92,94 are connected to the first and second ends 40,42 of the second die 18, respectively. The first and second blocks 92,94 are attached to the first and second ends 40,42 in any suitable manner such as by fasteners 96. The first and second blocks 92,94 have first and second pairs of spaced abutment members 98,100, respectively, for receiving the first and second handles 48,50, respectively, therebetween at the first position of the first and second handles 48,50, respectively, and prevents pivotal movement of the first and second handles 48,50 at this position by engaging the sides of the handles 48,50. The first and second handles 48,50 are spaced from being disposed between the first and second abutments 98,100, respectively, and free to pivot about the pins 80 at the second position.

Referring to FIGS. 6 and 7, the first and second blocks 92,94 are in pairs and connected to first and second sides 30,32 of the second die 18. The specific manner in which this connection is made will be subsequently discussed in greater detail. One of the first blocks 92 has a first pair of abutment members 98 and one of the second blocks 94 in a like manner has a second pair of abutment members 100. The other block of each pair of blocks has a flat surface 102 which is spaced from the first elongated bar 58 of the first and second die carrier handles 48,50 at the first position of the handles 48,50 and engaged with the elongated bar 58 at the second position of the first and second die carrier handles 48,50. It is to be mentioned that the third elongated bar 62 of the first and second die carrier handles 44,46 is disposed between the first and second pair of abutment members 98,100 at the first position so that pivotal movement is prevented. Conversely, at the second axial position of the third elongated bar 62 on the pins 80 (as shown in phantom) the third elongated bar 62 is free from being disposed between the first and second pair of abutment members 98,100 and free to pivotally move about the pins 80.

The first and second blocks 92,94 are slidably guidably connected to the first and second sides 30,32 of the second die for movement in the elongated direction of the second die so that the spacing between the first and second die carrier handles 48,50 may be properly positioned so that the load lifting device 74 may be engaged therewith and so that the first and second die carriers 44,46 may be pivotally moved in a direction without interference with the first and second dies 16,18. Specifically, a first guideway 104 is disposed in the first side 30 of the second die 18 and extends along the length of the second die 18 between the first and second ends 40,42 thereof. Similarly, a second guideway 106 is disposed in the second side 32 of the second die 18 and extends along the length of the second die 18 between the first and second ends 40,42 thereof. The first and second guideways 104,106 are "T"-shaped and substantially parallel to each other. A pair of spaced apart fastener means 108 is provided to connect each of the first and second blocks 92,94 to the second die 18 and to guide the first and second blocks 92,94 for movement along the first and second guideways 104,106. The fastener means 108 are adjustable to clamp the first and second blocks 92,94 to the second die 18 at a desired location along the guideways or to release the first and second blocks 92,94 for slidable movement along the first and second guideways 104,106. The fastener means 108 includes a guide member 110 slidably disposed in the guideways 104,106 and at least one jam nut 112 for connecting the guide member 110 to the associated one of the first and second blocks 92,94, and maintaining the blocks for either slidable movement or fixed connection to the second die 18.

With reference to FIGS. 1, 2, 6, and 7 the pins 80 are disposed between the first and second pairs of spaced abutment members 98,100 and allows for axial movement along the pins 80 of the first and second die carrier handles 48,50 between the first and second positions.

The first and second latch means 88,90 each include a plate 114 having a notch 116 disposed therethrough. Each plate 114 is pivotally connected to an associated die carrier handle 48,50, by a threaded fastener 118 at a location on the plate 114 spaced from the notch 116. The plate member 114 is disposed between the head 84 of the pin 80 and the associated die carrier handle 48,50 at the first position of the associated die carrier handle 48,50 and prevents axial movement of the associated die carrier handle 48,50 as long as the pin 80 is disposed in the notch 116.

Figure 9:
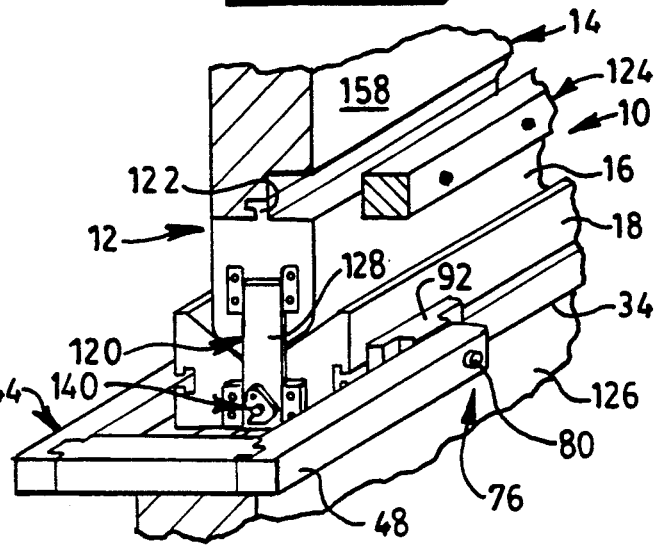
FIGS. 8, 9, and 10 are diagrammatic isometric views of the die set carrying arrangement of FIG. 6 showing the steps of the method of use.
Figure 8:
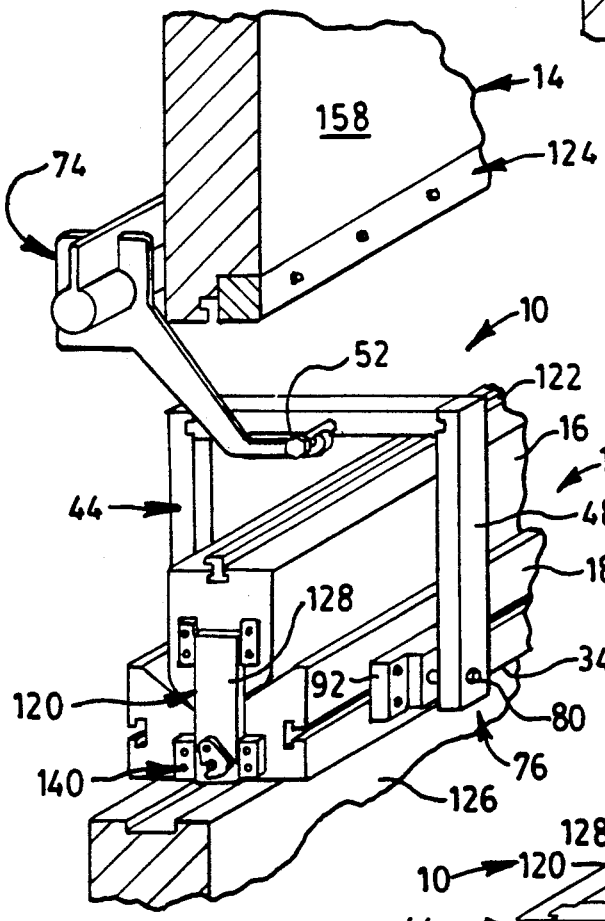
Figure 10:
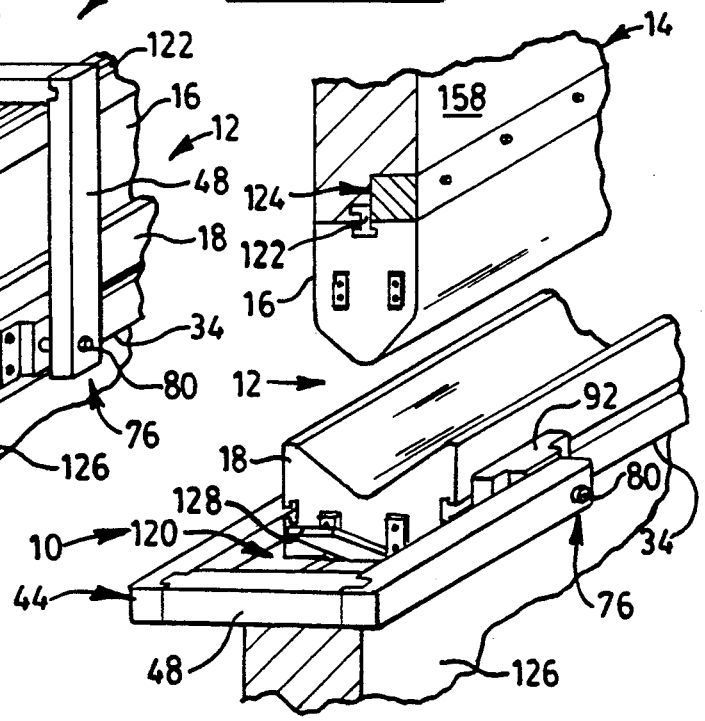

With reference to FIGS. 6 and 7, a support means 112 maintains the first die 16 at a predetermined orientation relative to the second die 18 so that a connecting portion 122 extending elevationally and longitudinally along the bearing surface 28 is aligned with a clamping jaw 124 of any suitable conventional design on the press 14 (see FIGS. 8, 9, and 10). Preferably the support means 120 maintains the bearing surface 28 of the first die substantially parallel to the bearing surface 34 of the second die 18.

Referring to FIGS. 6, 7, 8, 9, and 10, the support means 120 includes first and second guide plate members 128,130 each having first and second spaced end portions 132,134. The first end portion 132 of the first and second guide plate members 128,130 is connected to the first and second ends 40,42, respectively, of the second die 18. The first and second guide plate members 128,130 are pivotally movable about the pivotal connection between first and second spaced positions relative to the first and second dies 16,18. First and second pairs 136,138 are connected to the first and second ends 36,38 of the first die 18. The spacing between the first pair of guide flanges 136 and the spacing between the second pair of guide flanges is of a magnitude suitable for receiving therebetween the first and second guide plate members 128,130, respectively. The fit between the flanges 136,138 and the first and second guide plate members 128,130 is slidable and of a tolerance close enough to prevent rocking, cocking, and the like of the first die 16 while being nested on the second die 18. The first and second guide plate members 128,130 are disposed between the first and second pairs of guide flanges 136,138, respectively, at the first position of the first and second guide plate members 128,130 and spaced from being disposed between the first and second pairs of guide flanges 136,138 at the second position of the first and second guide plate members 128,130. The first and second guide plate members 128,130 are pivotally connected to the first and second ends 40,42 of the second die 18 in any suitable manner such as by a clevice and pin arrangement 142 as shown.

Means 140 releasably maintains the first and second guide plate members 128,130 from inadvertent movement from the first position. The releasable maintaining means 140 includes a pair of plates 144 having a notch 116 disposed therethrough and a threaded fastener for pivotally connecting each plate 144 to the associated first and second guide plate members 128,130. A fastener 150 having a head 152 cooperates with the notch 1 46 in the associated plate 144 and retains the first and second guide plate members 128,130 at the first position when engaged with the fastener 150. The fasteners 150 are screw threadably connected to the first and second ends 40,42 of the second die and passed through an aperture 154 disposed in the first and second guide plate members 128,130. The apertures 154 permit pivotal movement of the first and second guide plate members 128,130 in a passing relationship relative to the fastener 150 when the fastener 150 is free from being disposed in the notch 146.

Referring to FIGS. 11, 12, 13, 14, 15, and 16, a lever arm 156 is connected to the first die 16 and adapted to rock the first die 16 relative to the second die during mating engagement of the forming surfaces 20,22 and thereby position the connecting portion 122 relative to the clamping jaw 124 of the press 14. The rocking motion also permits the ram 158 of the press 14 to be lowered into engagement with the first die 16 and then rotated into position with the clamping jaw. This is especially beneficial in applications wherein the dies are extremely heavy and difficult to manipulate. The lever arm 156 is shown as being connected to the first end 36 of the first die 16, however, the lever arm 156 could be connected to either the first or the second ends 36,38 without departing from the spirit of the invention. Means 160 is provided for pivotally connecting the lever arm 156 to the first die 16 so that the lever arm 156 is pivotally movable between a first position at which it is parallel to the first side 24 and a second position at which the lever arm 156 extends at an angle relative to the first side 24. It should be noted that the lever arm 156 is suitable for use with the die set carrying arrangement 10 of FIGS. 1, 2, 6, and 7. The means 160 preferably includes a flange 162 connected to the first end and a pin 164 pivotally connecting the lever arm to the flange 162 at a location adjacent a corner of the first die 16 defined at the intersection of the first end 36 and side 24 of the first die 16. The lever arm 156 is closely adjacent the first side 24 at the first position of the lever arm so that the lever arm may be tucked away during subsequent forming operations. The flange 162 is attached to the first end 36 by a plurality of threaded fasteners 166 at a location closely adjacent the the bearing surface 28.

With reference to FIGS. 1 and 2, a pair of lifting device engaging members 168, identical in construction to items 52 and 54, are connected at the first and second ends 36,38 of the first die 16. These lifting device engaging members 168 facilitate elevational movement of the first die 16 relative to the second die 18 subsequent to placement of the second die 18 on the bed 126 of the press 14.

INDUSTRIAL APPLICABILITY

With reference to the drawings, and particularly FIGS. 1, 2, 3, 4, and 5, the die set carrying arrangement 10 enables match sets of first and second dies 16,18 to be transported between a storage location and a press brake. The first and second die carrier handles 48,50 are in the first locked upright position as shown in FIGS. 1 and 2 during transportation. The load lifting device 74 engages the lifting device engaging members 52,54 which allows the die set 12 to be carried to the press 14 for installation thereon.

Figure 3:
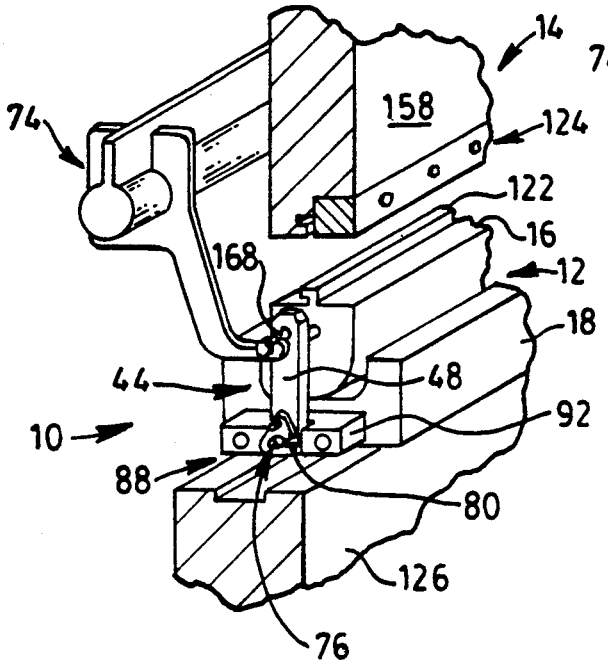
FIGS. 3, 4, and 5 are diagrammatic isometric views disclosing the die set carrying arrangement of FIG. 1 and the steps of the method of use.
Figure 4:
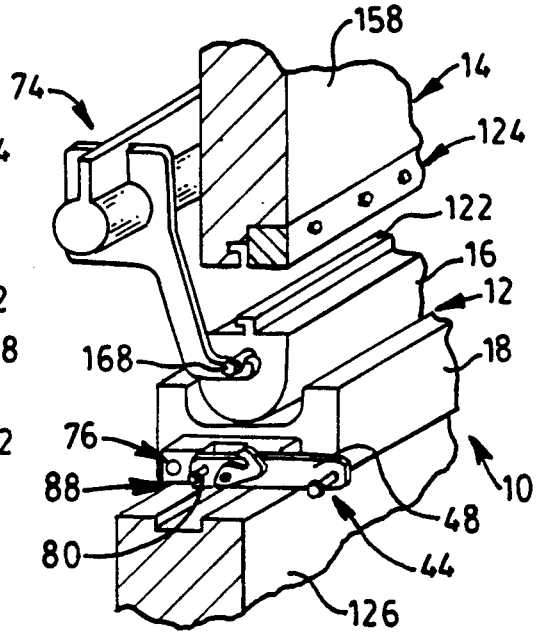
Figure 5:
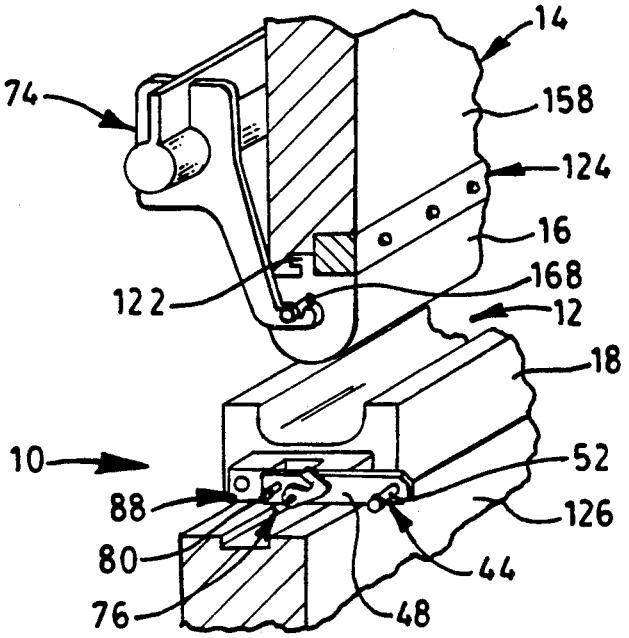

With reference to FIGS. 3, 4, and 5, the sequence of steps involved in installing the first and second die 16,18 on the press is shown. In FIG. 3, the lower die 18 is placed on the bed 126 thereof by the lifting device 74. Positioning of the lower die 18 on the bed 126 is easily achieved by the lifting device as it is carried by an overhead crane or the like (not shown). Once the lower die is positioned properly and in supported engagement on the bed 126, the lifting device is removed from connection to the engaging members 52,54 and moved out of the way. The first and second latch means 88,90 are then pivoted so that the notch 116 thereof is free from engagement with the respective pins 80. The first and second handles 48,50 are then axially slid on the pins 80 until they are at the second position. The first and second handles 48,50 are then rotated as shown to a substantially horizontal position relative to the bed 126 so that interference between the first and second handles 48,50 and the ram 158 is prevented. The load lifting device 74 is then connected to the lifting device engaging members 168 located on the first die 16 and the die 16 is raised until the clamping portion 122 of the first die is in seated engagement with the clamping jaw 124. The clamping jaw 124 is then clamped against the connecting portion 122 so that the first die remains attached to the ram 158. The load lifting device 74 is then moved from engagement with the lifting device engaging members 168 at the first and second ends 36,38 of the first die 16. Because of the above described die set carrying arrangement 10, the transfer of a match die set 12 is accomplished in a simple, economical manner and without the effort heretofore required.

With reference to the drawings of FIGS. 6, 7, 8, 9, and 10 the positioning of a die set 12 relative to the press brake in this embodiment of the die set carrying arrangement 10 is much similar to that as previously discussed. In this embodiment, like in the previous, the load lifting device 74 is connected to the first and second die carrying handles 48,50 by the outwardly projecting engaging members 52,54. In this embodiment the first and second die carriers 44,46 are longitudinally positionable along the second die 18 to accommodate the proper spacing for the various types of load lifting devices 74 being used. The longitudinal adjustability of the first and second die carriers 44,46 also enables the die carrier handles 48,50 to be pivoted about the pins 80 from a die carrying position as shown in FIG. 8 to a position shown in FIG. 9 wherein the first and second die carrying handles 48,50 are free from interference with the ram 158. To pivot the first and second handles 48,50 to the position as shown in FIGS. 9 and 10 the first and second latch means 88,90 is rotated to a release position at which the pin 80 is free from disposition in the notch 116 of plate 114. The first and second handles 48,50 are then axially moved along the pins 80 from a first position between the abutment means 98,100 to a second position at which the handles 48,50 are free from being located between the abutment means 98,100. At this second position the first and second handles 48,50 are rotated to the lowered position. Since the second die was previously placed in position on the bed 126 and the die handles 48,50 have been rotated to the lowered position the first die 16 is now ready to be connected to the ram 158. To connect the first die 16 to the ram, the ram is simply lowered down unto the first die 16 until engagement with the bearing surface 28 is made. The clamping jaw is then secured a position against the connecting portion 122 of the first die 16. The first die 16 is now secured to the ram and movable in response to elevational movement of the ram 158.

The support means 120 maintains the first die 16 at the proper position relative to the second die 18 so that the ram 158 and the connecting portion 122 is aligned with the clamping jaw 124. In this manner the lifting device engaging members 168 are not required on the first die 16 because the ram 158 is lowered instead of the die 16 being lifted, as previously noted. The first and second guide plates 128,130 are pivoted to a location at which they are free from engagement and interference with the first die 16 so that the forming operation may commence without the support means 120 interfering with the stock being formed. To lower the first and second guide plate members 128,130 one simply needs to pivot the releasable maintaining means 140 so that the pin 150 is free from disposition in the notch 146 and pivot the plates 128,130 to the desired location.

Figure 11:
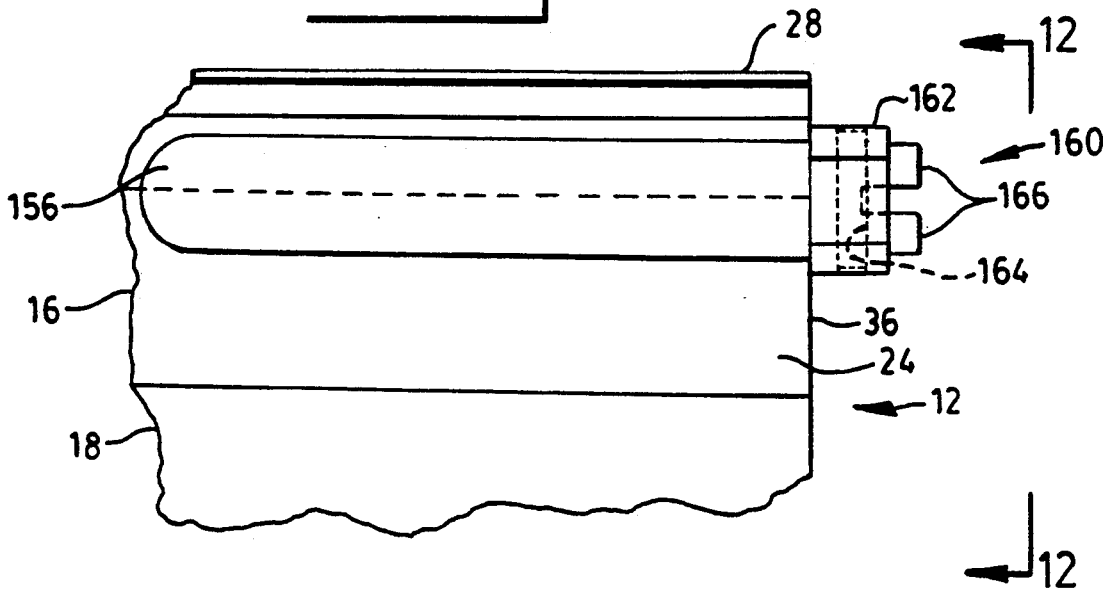
FIG. 11 is a diagrammatic partial side view of a die set showing a lever arm for rocking a first die relative to a second die.
Figure 12:
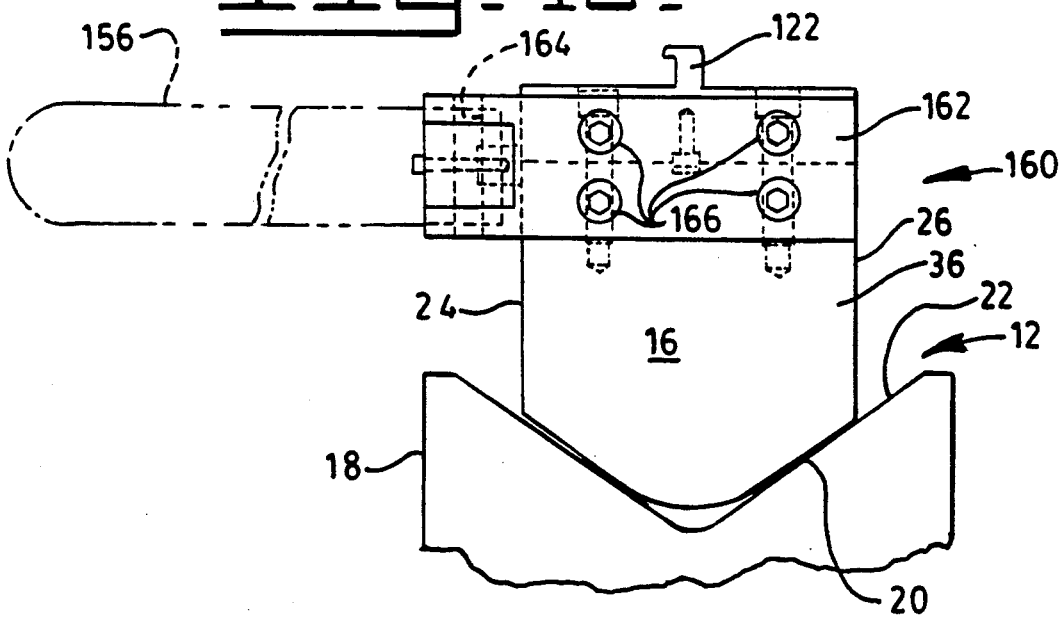
FIG. 12 is a diagrammatic view taken along lines 12—12 of FIG. 11 showing the lever arm in greater detail.
Figure 13:
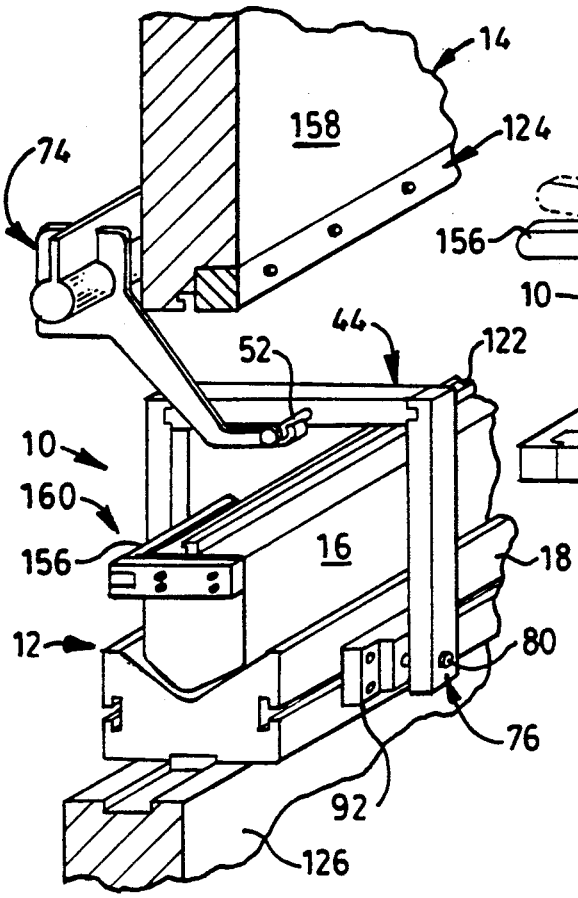
FIGS. 13, 14, 15, and 16 are diagrammatic isometric views showing the die set carrying arrangement of FIG. 6, the lever arm of FIG. 7 and the steps of the method of use of the die set carrying arrangement and lever arm.
Figure 14:
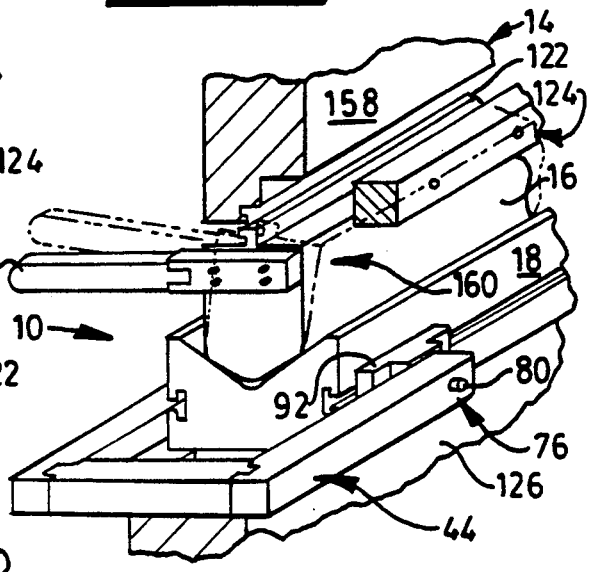
Figure 16:
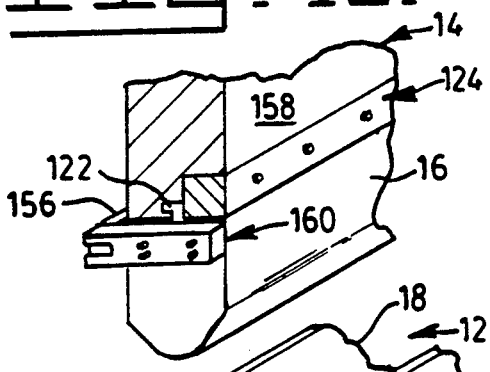
Figure 15:
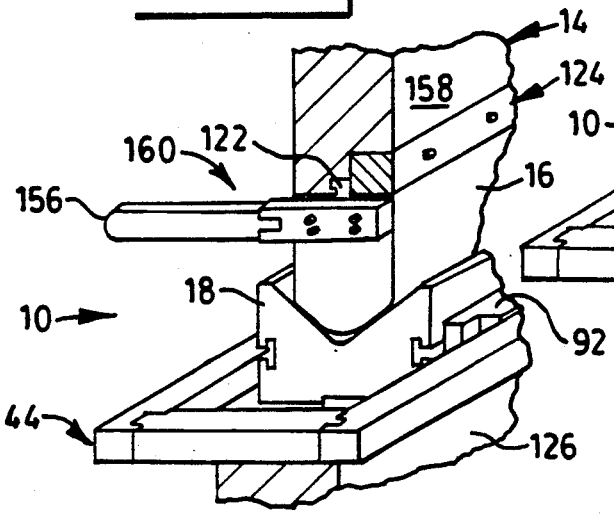
Figure 15:
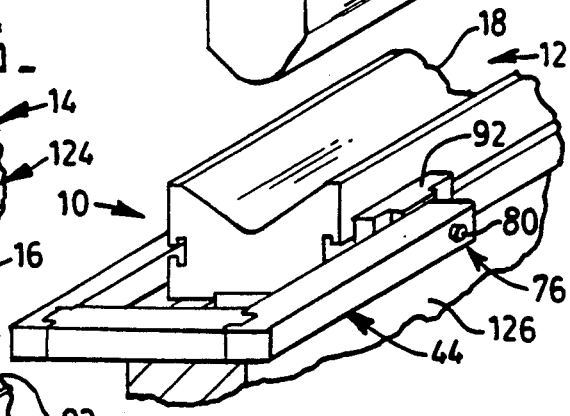

With reference to FIGS. 11, 12, 13, 14, 15, and 16, the sequence of steps required to connect the upper and lower dies 16,18 to the ram 158 and the bed, respectively, is identical to that as described with respect to FIGS. 8, 9, and 10 with the exception that the support means 120 is absent and a lever arm 156 is provided to rock the first die 16 relative to the second die 18 and thereby assist in aligning the upper die with the clamping jaw 124 so that proper engagement and clamping may be achieved with a minimum amount of effort. The lever arm 156 which extends transversely relative to the length of the die 16 provides a lever 156 of sufficient length to facilitate ease of rocking of the upper die 16 even in applications where the die is of a substantial size and weight. Upon connection of the upper die 16 to the ram 158 the lever arm 156 is pivoted about pin 164 to a stored position closely adjacent the side 24 as shown in FIGS. 11 and 12 so that inadvertent interference between the lever 156 and other objects such as the steel plate being formed is prevented.

Other aspects, objects and advantages of the present invention can be obtained from a study of the drawings, the disclosure and the appended claims.

I claim:

1. A die set carrying arrangement: comprising:

first and second mated dies each having a forming surface, said first die forming surface being in cradled engagement with said second die forming surface;

first and second die carriers each having a handle and a lifting device engaging member connected to each of said handles;

first pin means for pivotally and axially slidably connecting the first die carrier handle to the second die;

second pin means for pivotally and axially slidably connecting the second die carrier handle to the second die, said first and second pin means being connected to the second die at spaced locations, said first die carrier handle being movable along a longitudinal axis of the first pin means between first and second spaced axial positions, and said second die carrier handle being movable along a longitudinal axis of the second pin means between first and second spaced axial positions;

first latch means for maintaining the first die carrier handle from pivotal movement about said first pin means in response to said first die carrier handle being at the first position along the longitudinal axis of said first pin means; and second latch means for maintaining the second die carrier handle form pivotal movement about said second pin means in response to said second die carrier handle being at the first position along the longitudinal axis of said second pin means, said first and second latch means being connected to the second die and positioned to engage the first and second die carrier handles at the first axial position of the first and second die carrier handles.

2. A die set carrying arrangement, as set forth in claim 1, wherein said first and second latch means each include a plate, said first latch means plate being movable to release the first die carrier handle for axial movement relative to said first pin longitudinal axis to said second position, and said second latch means plate being movable to release the second die carrier handle for axial movement relative to said second pin longitudinal axis to said second position, said first and second die carrier handles being free to pivotally move about said first and second pin means longitudinal axis at the second position.

3. A die set carrying arrangement, as set forth in claim 1, including first and second pairs of spaced abutment members connected at spaced apart locations to said second die member, said first die carrier handle being disposed between and engageable with the first pair of spaced abutment members at the first position, and said second die carrier handle being disposed between and engageable with the second pair of spaced abutment members at the first position of the second pair of spaced abutment members.

4. A die set carrying arrangement, as set forth in claim 3, wherein said first and second pin means each having a head, said first and second die carrier handles being slidably movable on the first and second pins, respectively, and spaced from being disposed between the first and second pairs of spaced abutment members, respectively, at the second position of the first and second die carrier handles, said first and second handles being engagable with the head of the first and second pin means, respectively, at the second position of the first and second handles.

5. A die set carrying arrangement, as set forth in claim 3, wherein said first and second pin means is disposed between the abutment members of the first and second pairs of abutment members, respectively, and connected to the second die, said first and second handles each having a bore disposed therein, said first and second pin means being slidably disposed in the bore of the first and second handles, respectively.

6. A die set carrying arrangement, as set forth in claim 3, wherein said first and second pin means each includes a pin and a head portion, said first and second latch means each include a plate member having a notch, said plate members being pivotally connected to the die carrier handles at a location on the plate members spaced from the notch, said plate members being disposed between the head and the die carrier handles and said pins being disposed in the notch of the plate members at the first position of the die carrier handle.

7. A die set carrying arrangement, as set forth in claim 3, wherein said second die has first and second spaced ends and said lifting device engaging members extend from the handles of the first and second die carriers in directions substantially normal to one of the first and second ends of the second die.

8. A die set carrying arrangement, as set forth in claim 3, wherein said second die member is elongated and has first and second sides extending in the direction of elongation, said first and second die carrier handles each having first and second end portions, and including:

first and second guideways disposed in and extending along the length of the first and second sides; and first and second guide block pairs, one guide block of each of the first and second guide block pairs being slidably guidably connected to said first guideway and the other guide block of each of the first and second guide block pairs being slidably guidably connected to said second guideway, said first pin means pivotally and axially slidably connecting the first end portion of the first die carrier handle to the one of the guide blocks of the first pair and the second end portion of the first die carrier handle to the other of the guide blocks of the first pair, said second pin means pivotally and axially slidably connecting the first end portion of the second die carrier handle to one of the guide blocks of the second pair and the second end portion of the second die carrier handle to the other guide block of the second pair, said first abutment member pair being connected to one of the blocks of the first guide block pairs, and said second abutment member pair being connected to one of the blocks of the second guide block pairs, said first and second end portions of the first handle being slidably movable along the first pin means longitudinal axis to said first position at which said first end portion of the first handle is disposed between the first abutment member pair, said first and second end portions of the second handle being slidably movable along the second pin means longitudinal axis to said first position at which said first end portion of the second handle is disposed between the second abutment member pair, said first and second handles being maintained from pivotal movement about the first and second pin means longitudinal axis at the first position.

9. A die set carrying arrangement, as set forth in claim 8, wherein said first and second carrier handles are substantially "U" shaped.

10. A die set carrying arrangement, as set forth in claim 8, including:

fastener means for maintaining the first and second guide block pairs at preselected locations along the guideways.

11. A die set carrying arrangement, as set forth in claim 3, wherein said second die has first and second spaced ends and said first and second die carrier handles are pivotally connected to the first and second ends of the second die.

12. A die set carrying arrangement, as set forth in claim 1, including support means for maintaining the first die a a predetermined orientation relative to the second die, said support means being connected to one of the first and second dies and engagable with the other of the first and second dies.

13. A die set carrying arrangement, as set forth in claim 12, wherein said first die has first and second spaced end portions and said support means includes;

first and second guide plate members each having first and second end portions and being pivotally connected at the first end portion to the first and second end portions respectively of the second die member, said first and second guide plate members being pivotally movable between first and second spaced positions;

first and second pairs of spaced guide flanges, said first pair of guide flanges being connected to the first end portion of the first die and said second pair of guide flanges being connected to the second end portion of the first die, said first and second guide plate members being disposed between the first and second pairs of guide flanges, respectively, at the first position of the first and second guide plates and spaced from being disposed between the first and second pairs of guide flanges at the second position of said first and second guide plate members.

14. A die set carrying arrangement, as set forth in claim 13, including means for releasably maintaining the first and second guide plate members at the first position.

15. A die set carrying arrangement, as set forth in claim 1, including a lever arm connected to the first die and being adapted to the rock the first die relative to the second die.

16. A die set carrying arrangement, as set forth in claim 15, wherein the first die has a first side and including means for pivotally connecting the lever arm to the first die, said lever arm being pivotally movable between a first position at which the lever arm is parallel to the first side and a second position at which the lever arm extends at an angle relative to the first side.

17. A die set carrying arrangement, as set forth in claim 16, wherein first die has a first end, said first end being substantially normal to the first side and defining a corner between the first side and first end, said lever connecting means including:

a flange connected to the first end; and a pin pivotally connecting the lever to the flange at a location adjacent the corner, said lever being closely adjacent the first side at the first position of the lever.

18. A method for positioning a die set relative to a press brake having a bed and a ram, said die set having first and second dies, first and second die carrier handles pivotally connected to the second die and pivotally movable between a first position at which the die set is adapted to be carried by the first and second die carrier handles and a second position spaced from the first position at which the first die is adapted to be connected to the ram, said method comprising the steps of:

carrying the die set by the first and second die carrier handles;

placing the second die in position on the bed;

pivoting first and second die carrier handles to the second position and freeing the die carrier handles from interference with the ram; and connecting the ram to the first die.

19. The method as set forth in claim 18, wherein the ram has a bearing surface, the first die has a bearing surface, and the ram has a die connecting clamp, including the steps of:

moving the ram until the bearing surface of the first die is in engagement with the bearing surface of the ram; and clamping the first die to the ram.

20. The method as set forth in claim 18, including first and second latch means for maintaining the first and second die carrier handles at the first position, said first and second latch means being movable to release the first and second handles for pivotal movement between the first and second positions, and including the steps of:

moving the first and second latch means and releasing the first and second die carrier handles for pivotal movement between the first and second positions;

pivotally moving the first and second die carrier handles to the second position and clearing the first and second die carrying handles from interfering with the connection of the first die to the ram.

21. The method as set forth in claim 18, including a lever arm connected to the first die, and including the step of rocking the first die relative to the second die by the lever and aligning the first die with the second die.

22. The method as set forth in claim 18, wherein the die set includes, support means for maintaining the first die at a predetermined orientation relative to the second die, said support means being pivotally connected to the second die, including the step of pivotally moving the support means and releasing the first die from being maintained at the predetermined orientation relative to the second die.

23. A carrying arrangement for a die set having first and second matable dies each having a forming surface, said first die forming surface being cradled by the second die forming surface; comprising:

first and second die carriers each having a handle and a lifting device engaging member connected to each of said handles;

first pin means for pivotally connecting the first die carrier handle to the second die, said first pin means being connected to the second die;

second pin means for pivotally connecting the second die carrier handle to the second die, said second pin means being connected to the second die at a location on the second die spaced from the first pin means, said first and second die carrier handles being spaced from each other;

first latch means for maintaining the first die carrier handle from pivotal movement about said first pin means and at a preselected die set carrying position;

a second latch means for maintaining the second die carrier handle from pivotal movement about said second pin means and at a preselected die set carrying position, said first and second latch means each being movable to release the first and second die carrier handles for pivotal movement about the first and second pin means, said first and second latch means each including an abutment means, said abutment means being connected to said second die adjacent the first and second pin mans and relatively movable with respect to the first and second die carrier handles between a first position at which said first and second die carrier handles are engaged with said abutment means and a second position spaced from said first position at which said first and second die carrier handles are spaced from engagement with said abutment means, said first and second die carrier handles being maintained from pivotal movement about said first and second shaft means at the first position and free to pivot about said first and second pin means at the second position.

* * * * *